US006712049B2

(12) United States Patent
Kawano

(10) Patent No.: US 6,712,049 B2
(45) Date of Patent: Mar. 30, 2004

(54) EVAPORATIVE EMISSION CONTROL SYSTEM

(75) Inventor: Akihiro Kawano, Atsugi (JP)

(73) Assignee: Nissan Motor Co., Ltd., Yokohama (JP)

( * ) Notice: Subject to any disclaimer, the term of this patent is extended or adjusted under 35 U.S.C. 154(b) by 85 days.

(21) Appl. No.: 10/165,300

(22) Filed: Jun. 10, 2002

(65) Prior Publication Data

US 2003/0019482 A1 Jan. 30, 2003

(30) Foreign Application Priority Data

Jul. 30, 2001 (JP) ..... 2001-228953
Mar. 13, 2002 (JP) ..... 2002-068534

(51) Int. Cl.[7] ..... F02M 33/02
(52) U.S. Cl. ..... 123/520; 73/118.1
(58) Field of Search ..... 123/520, 519, 123/518, 516, 198 D; 73/118.1

(56) References Cited

U.S. PATENT DOCUMENTS 5,669,362 A * 9/1997 Shinohara et al. ..... 123/520
5,780,728 A * 7/1998 Takamori ..... 73/116
5,845,625 A * 12/1998 Kidokoro et al. ..... 123/520
5,911,209 A * 6/1999 Kouda et al. ..... 123/520
6,276,343 B1 * 8/2001 Kawamura et al. ..... 123/520

FOREIGN PATENT DOCUMENTS

JP 7-317611 12/1995

* cited by examiner

*Primary Examiner*—Mahmoud Gimie
(74) *Attorney, Agent, or Firm*—Foley & Lardner

(57) ABSTRACT

An evaporative emission control system for an engine (1) includes a fuel tank (2), a pipe (4, 7) connecting the fuel tank and an engine intake passage, a canister (3) which adsorbs fuel evaporating gas vaporized in the fuel tank, a purge valve (8) provided between the intake passage and the canister, and a sensor (9) which is provided between the purge valve and the fuel tank, and detects absolute pressure in the pipe. A controller (15) sets the detected pressure before engine startup as an atmospheric pressure.

11 Claims, 14 Drawing Sheets

EVAPORATIVE EMISSION CONTROL SYSTEM

FIELD OF THE INVENTION

This invention relates to fault diagnosis of an evaporative emission control system which prevents fuel evaporating gas from leaking to the atmosphere.

BACKGROUND OF THE INVENTION

JP-A-H7-317611 published by the Japanese Patent Office in 1995 discloses a diagnosis of an evaporative emission control system. In this system, an absolute pressure sensor is installed midway in a passage which connects a fuel tank and a canister, and the atmospheric pressure measured by an atmospheric pressure sensor separately installed outside the system is set as a reference pressure. Faults of the evaporative emission control system are diagnosed based on the differential pressure between the reference pressure and the pressure in a passage.

SUMMARY OF THE INVENTION

However, in the conventional fault diagnosis, in addition to the absolute pressure sensor in the system, it is necessary to provide an atmospheric pressure sensor separately outside the system.

It is therefore an object of this invention to diagnose a fault of an evaporative emission control system from the measurement result of an absolute pressure sensor without providing an absolute pressure sensor outside the system.

In order to achieve above object, this invention provides a fuel evaporative emission control system of an engine comprising a fuel tank, a passage connecting the fuel tank and an intake passage of the engine, a canister provided in the passage, which adsorbs fuel evaporating gas vaporized in the fuel tank, a purge valve installed between the intake passage and the canister, a sensor which is provided between the purge valve and the fuel tank and detects the pressure in the passage, and a controller functioning to detect the pressure in the passage before engine startup as an atmospheric pressure.

According to an aspect of the present invention, this invention provides a fuel evaporative emission control system of an engine, comprising a fuel tank, a passage connecting the fuel tank and an intake passage of the engine, a canister provided in the passage, which adsorbs fuel evaporating gas vaporized in the fuel tank, a purge valve installed between the intake passage and the canister, a sensor which is provided between the purge valve and the fuel tank and detects the pressure in the passage, and a controller functioning to detect the pressure in the passage before engine startup as a first pressure, detect the pressure in the passage after engine startup as a second pressure, compute the pressure difference between the first pressure and the second pressure, and determine a fault of the purge valve based on the pressure difference.

The details as well as other features and advantages of this invention are set forth in the remainder of the specification and are shown in the accompanying drawings.

DESCRIPTION OF THE PREFERRED EMBODIMENTS

Figure 1:
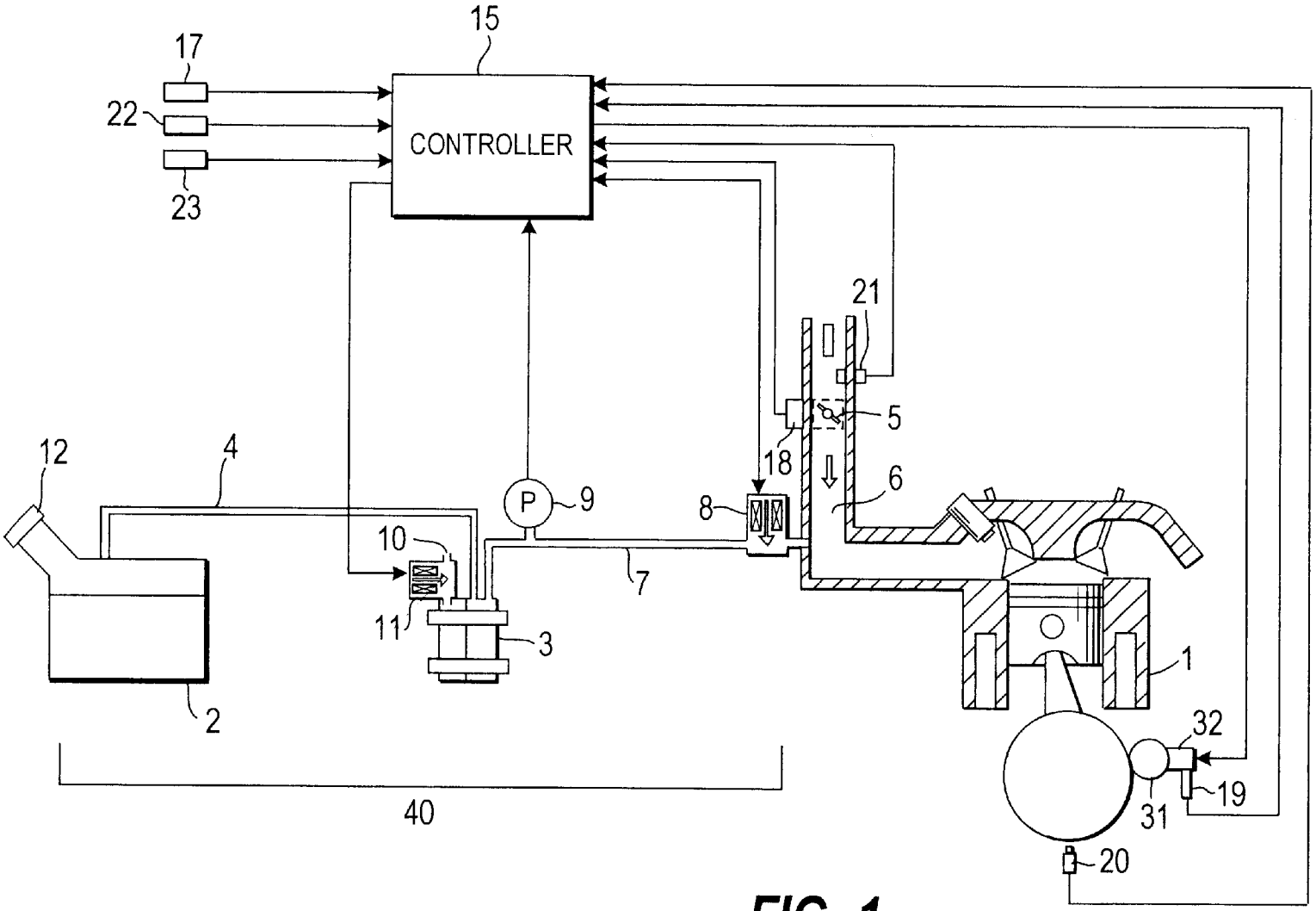
FIG. 1 is a schematic diagram of a fuel evaporative emission control system relating to this invention.

Referring to FIG. 1 of the drawings, a fuel evaporative emission control system for an engine 1 comprises a canister 3 incorporating a fuel adsorbent such as activated carbon, a first pipe 4 connecting the canister 3 with a fuel tank 2, and a second pipe 7 connecting the canister 3 with an intake passage 6 downstream of a throttle valve 5 of the engine 1. The evaporative emission control system prevents fuel evaporating gas generated in the fuel tank 2 of the engine 1 from leaking into the atmosphere.

A purge valve 8 is provided in the second pipe 7. The purge valve 8 opens and closes the second pipe 7. In the second pipe 7, an absolute pressure sensor 9 which measures the pressure (absolute pressure) in the pipe between the fuel tank 2 and purge valve 8, is provided between the purge valve 8 and canister 3. The absolute pressure sensor 9 may be provided in the pipe between the fuel tank 2 and the purge valve 8. For example, the absolute pressure sensor 9 may be installed in the first pipe 4.

A canister 3 has an atmospheric opening 10. A drain cut valve 11 which opens and closes the atmospheric opening 10 is provided in the atmospheric opening 10.

Fuel evaporating gas generated in the fuel tank 2 is led to the canister 3 through the first pipe 4. The fuel components of the fuel evaporating gas introduced into the canister 3 are adsorbed by the activated carbon in the canister 3, and the remaining air is discharged outside from the atmospheric opening 10. In order to process the fuel adsorbed by the activated carbon, the purge valve 8 is opened according to a signal from a controller 15 which shows a running state of the vehicle, and fresh air is introduced into the canister 3 from the atmospheric opening 10 using the intake negative pressure downstream of the throttle valve 5. When the fresh air is introduced in the canister 3, the fuel adsorbed on the activated carbon is released, and is introduced together with the fresh air into the intake passage 6 of the engine 1 through the second pipe 7.

The detection value of the absolute pressure sensor 9 is output to the controller 15. The detection value of the absolute pressure sensor 9 and signals from various sensors which detect the running state of the vehicle are input into the controller 15. The sensors which detect the running state of the vehicle comprise a vehicle speed sensor 17 which detects a vehicle speed VSP, a throttle opening sensor 18 which detects a throttle opening TVO of the engine 1, a mechanical sensor 19 which detects ON/OFF of a starter switch 32 of a starter motor 31, a crank angle sensor 20, a boost pressure sensor 21 which detects a boost pressure in the intake passage 6, an ignition switch 22 and a battery voltage sensor 23 which detects a battery voltage VB.

The mechanical sensor 19 can detect ON/OFF of the starter switch 32 mechanically without delay. The crank angle sensor 20 is an electromagnetic pickup type, and it detects the position of the crankshaft of the engine 1 electrically from the rotation of a timing plate attached to the crankshaft. The detection signals are used for controlling the engine 1 and detecting the rotation speed of the engine 1.

The controller 15 comprises one, two or more microprocessors, a memory, an input-and-output interface, etc. Based on the input signals, the controller 15 opens the purge valve 8 in predetermined operation regions, such as during steady running etc., and performs purge processing which processes the fuel adsorbed by the canister 3.

The controller 15 also performs fault diagnosis of the purge valve 8 and leak determination of the fuel tank 2 and pipes 4, 7 based on the signal input as described later.

The fault diagnosis of the purge valve 8 performed by the controller 15 will now be described referring to the flowcharts shown in FIG. 2 and FIG. 3.

Figure 2:
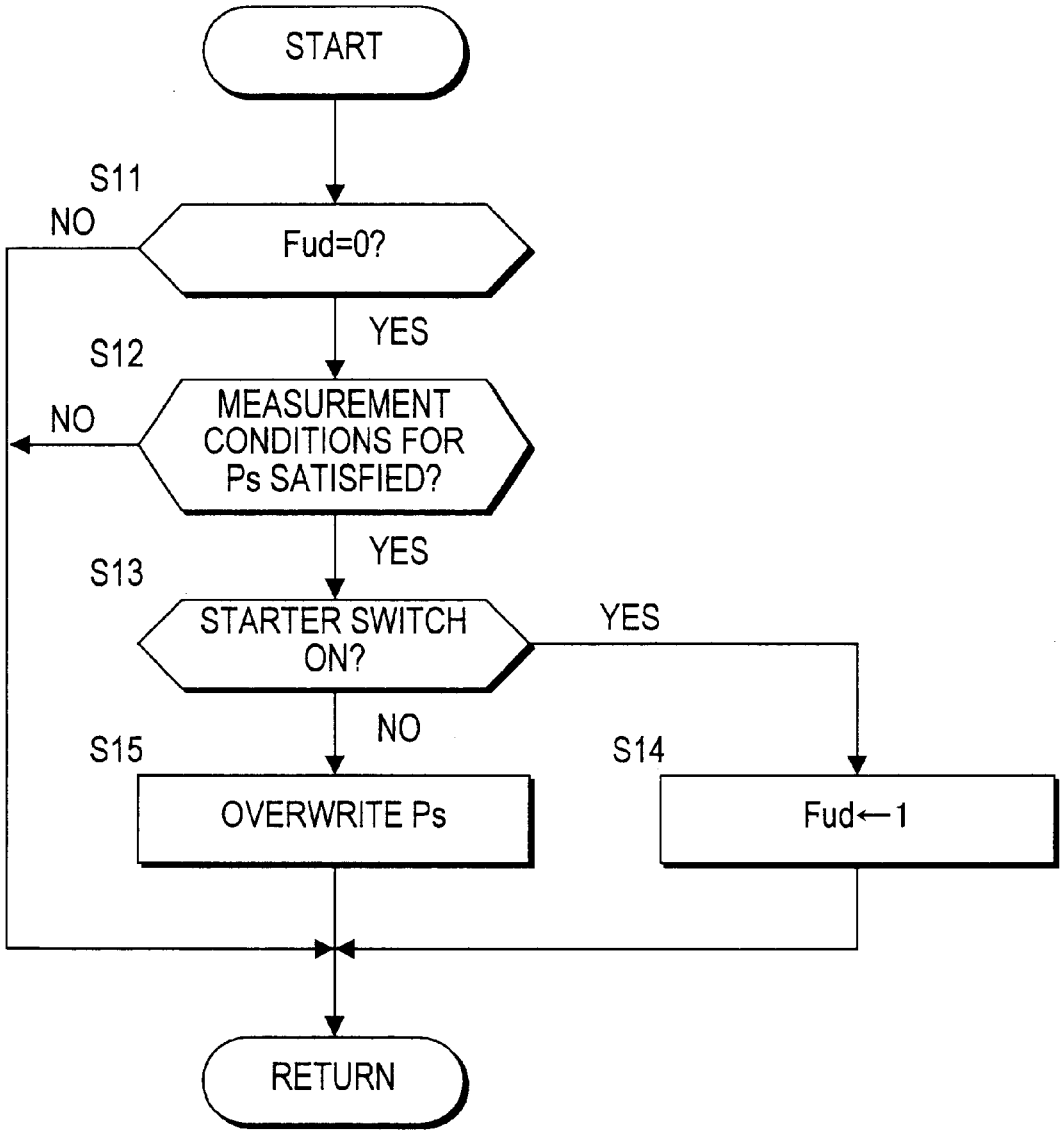
FIG. 2 is a flowchart showing a reference pressure setting processing.

FIG. 2 is a flowchart showing the details of control for setting a reference pressure Ps, and is performed at a fixed interval, for example, 10 milliseconds. The initial value of the reference pressure Ps is stored beforehand.

In a step S11, it is determined whether or not an updating flag Fud is "0." When the updating flag Fud is "0", the routine proceeds to a step S12, and it is determined whether or not the measurement conditions for the reference pressure Ps are satisfied. On the other hand, this routine is terminated when the updating flag Fud is "1." The initial value of the updating flag Fud is "0."

In order to determine that the measurement conditions for the reference pressure Ps are satisfied, it is necessary to satisfy all the following conditions:

(1) No Fail determination is issued, such as when other components such as the boost pressure sensor 21 in the intake passage 6, are faulty.

(2) The drain cut valve 11 is open.

(3) The purge valve 8 is closed.

(4) The ignition switch 22 is ON (5) The engine rotation speed Ne is lower than a first predetermined rotation speed (for example, 500 rpm).

(6) The battery voltage VB is higher than 8V.

When all of these conditions are satisfied, the routine proceeds to a step S13, and it is determined whether the starter switch 32 which starts the starter motor 31 is ON based on a signal from the mechanical sensor 19. When the measurement conditions are not satisfied, the control is terminated.

When the starter switch 32 is ON, the routine proceeds to a step S14, the updating flag Fud is changed" from "0" to "1", and control is terminated. When it is OFF, the routine proceeds to a step S15, the reference pressure Ps is overwritten by the value detected by the absolute pressure sensor 9, and this routine is terminated. Thus, the reference pressure Ps becomes a pressure which is effectively equivalent to atmospheric pressure.

By this processing, the detection value of the absolute pressure sensor 9 just before the starter switch 32 is turned on is set as the reference pressure Ps.

Figure 3:
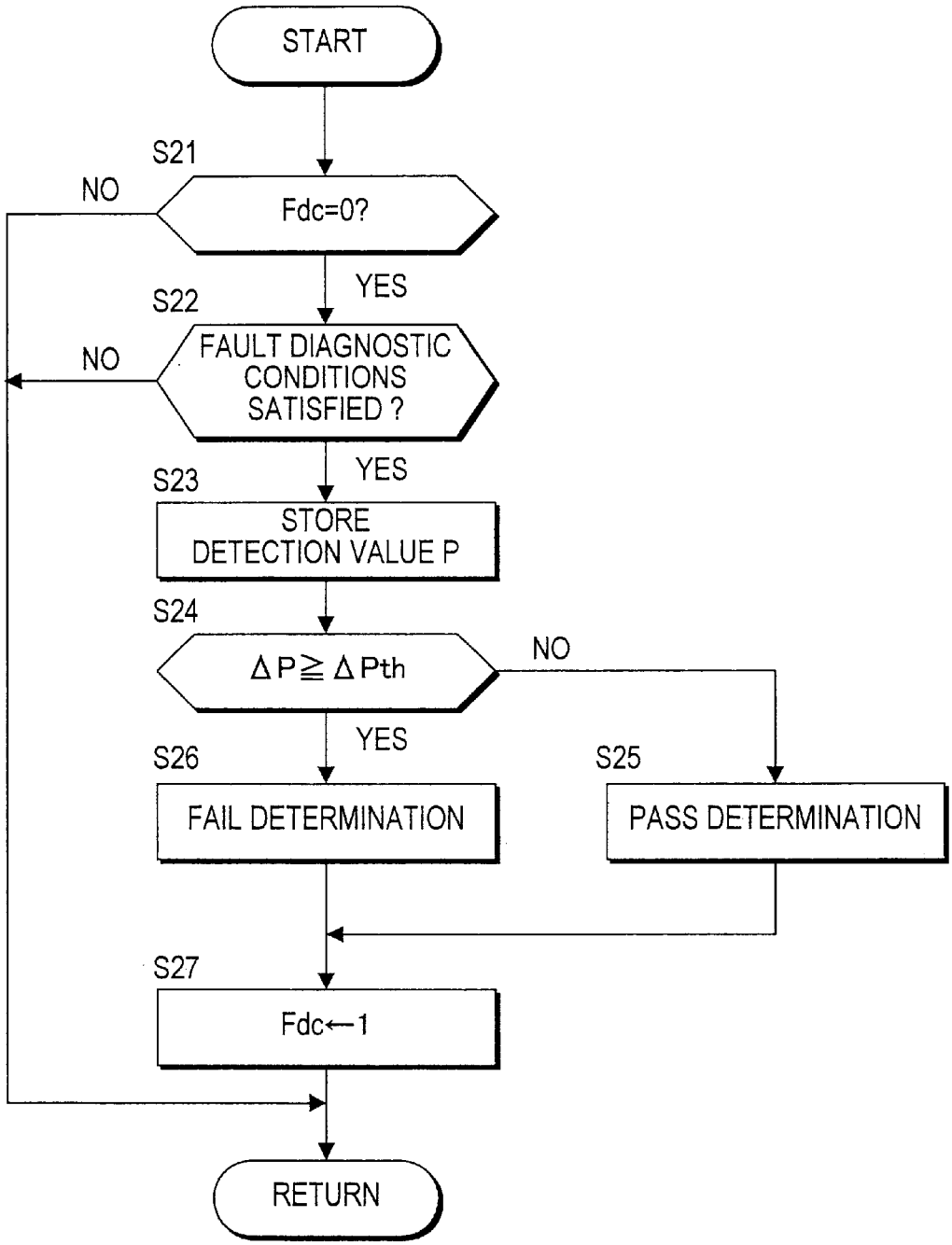
FIG. 3 is a flowchart showing a fault determining processing of a purge valve of the system.

If the reference pressure Ps is set up by the above-mentioned processing, the flowchart shown in FIG. 3 will be performed, and fault diagnosis of the purge valve 8 will be performed. A fault of the purge valve 8 mainly means a fault in which the purge valve 8 remains open due to a stick of the purge valve 8 or a defect of the solenoid which drives the purge valve 8. This flowchart is carried out at a fixed interval, for example, 100 milliseconds.

In a step S21, it is determined whether or not a flag Fdc showing that fault diagnosis of the purge valve 8 is complete, is "0." When the Flag Fdc is "0" (fault diagnosis is not complete), the routine proceeds to a step S22, and when it is "1", control is terminated. The initial value of the flag Fdc is "0."

In a step S22, it is determined whether fault diagnostic conditions are satisfied. In order to determine that fault diagnostic conditions are satisfied, it is necessary to satisfy all the following conditions:

(1) No Fail determination is issued, such as when other components, for example, the boost pressure sensor 21 in the intake passage 6, is faulty.

(2) The drain cut valve 11 is open.

(3) The purge valve 8 is closed.

(4) The ignition switch 22 is ON.

(5) The rotation speed Ne of the engine 1 is lower than a second predetermined rotation speed (for example, 500 rpm).

(6) The battery voltage VB is higher than 11V.

(7) The starter switch 32 is OFF.

(8) The updating flag Fud of the reference pressure is "1."

(9) The conditions (1)–(8) above continue for a first predetermined time (e.g., 1 second).

(10) A second predetermined time (for example, 10 seconds) after completion of measurement of the reference pressure Ps, has not elapsed.

When fault diagnostic conditions are satisfied, the routine proceeds to a step S23, and when they are not satisfied, this routine is terminated.

In a step S23, the detection value of the absolute pressure sensor 9 is stored in a memory as a detection pressure P for fault diagnosis.

In a step S24, a difference ΔP of the detection pressure P and the reference pressure Ps is computed, and it is determined whether or not the differential-pressure ΔP is more than a predetermined pressure ΔPth (for example, 5 mmHg).

If the purge valve 8 breaks down and remains open, the negative pressure in the intake passage 6 of engine 1 is introduced into the pipes 4, 7 and the above-mentioned differential-pressure ΔP increases. Therefore, when the differential-pressure ΔP is more than the predetermined differential-pressure ΔPth, the routine proceeds to a step S26, and it is determined that the purge valve 8 is faulty (Fail determination). An alarm or a warning message etc., is then emitted to notify that the purge valve 8 has a fault.

On the other hand, if the purge valve 8 is normal, the pipes 4, 7 will be cut off from the intake passage 6 by the purge valve 8 even if the engine 1 starts and negative pressure arises in the intake passage 6, so the pressure in the pipes 4, 7 is effectively atmospheric pressure, and the differential-pressure ΔP becomes a value near zero. Therefore, when the differential-pressure ΔP does not reach the predetermined differential-pressure ΔPth, the routine proceeds to the step S25 and it is determined that the purge valve 8 is operating normally (Pass determination).

In a step 27, the fault diagnostic completion flag Fdc is set to "1" showing that fault diagnosis of the purge valve 8 was completed, and this routine is terminated.

Figure 4:
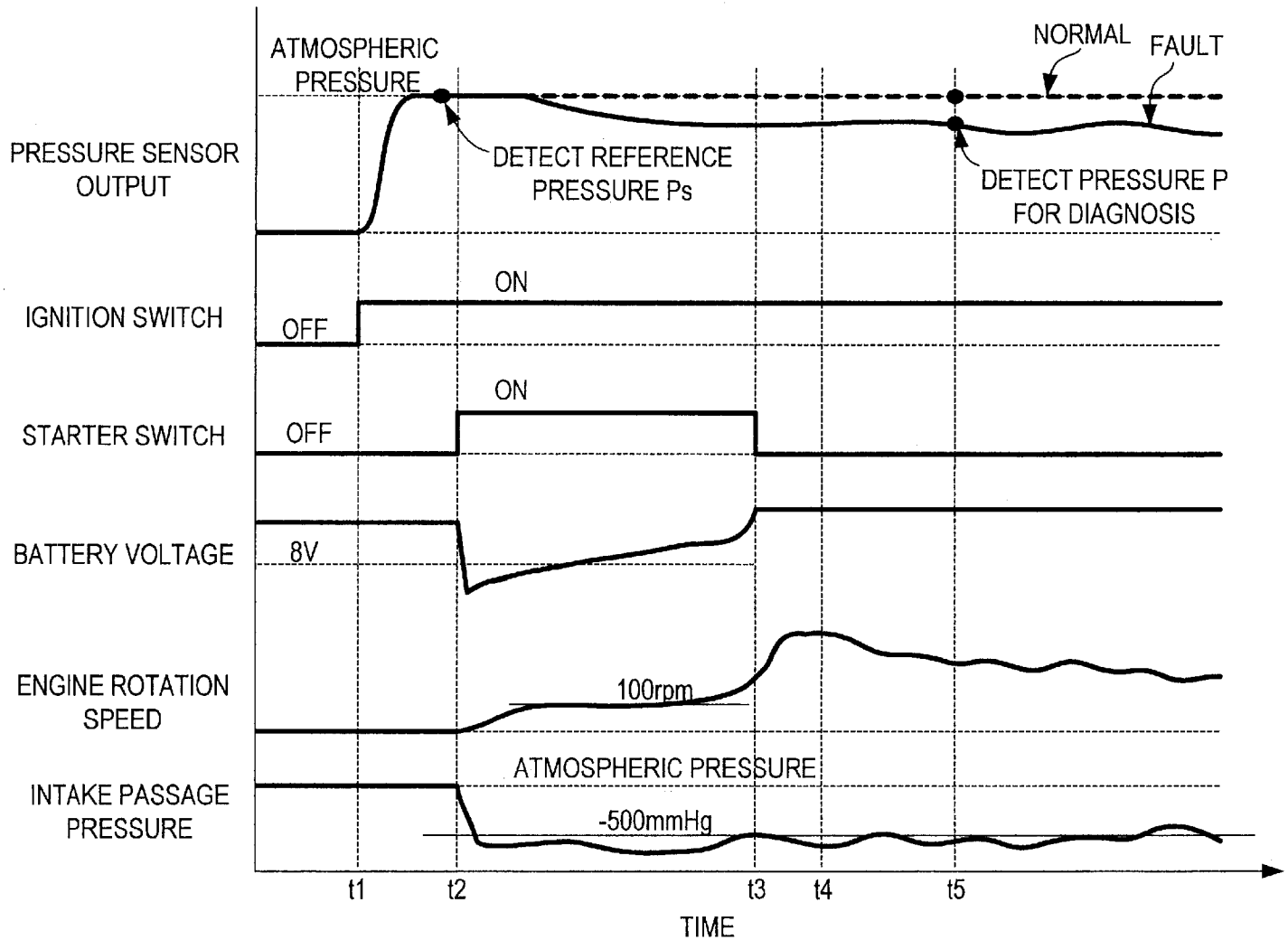
FIG. 4 is a timing chart showing the operation of the system when performing fault determining processing of the purge valve.

The timing chart of FIG. 4 shows the operating state of each component when performing fault diagnosis of the purge valve 8.

At a time t1, the measurement conditions for the reference pressure Ps are determined, and when the conditions are satisfied and the starter switch 32 is OFF, the detection value of the absolute pressure sensor 9 is stored as the reference pressure Ps to update the reference pressure Ps. The updating of the reference pressure Ps is continued just before the starter switch 32 is turned on at the time t2, i.e., just before starting of the engine 1.

The reason for terminating pressure detection when the starter switch 32 is turned on is that, when the starter switch 32 is turned on, cranking starts and the pressure in the pipes 4, 7 becomes unstable, so it is desired to eliminate this effect. Consequently, the reference pressure Ps can be set to a value effectively near atmospheric pressure.

At the time t2, the starter switch 32 is turned on and the engine 1 starts. At the same time, the battery voltage VB falls and the pressure in the intake passage 6 also declines.

At a time t3, the starter switch 32 is OFF but the engine 1 continues to rotate. As the starter motor 31 stops if the starter switch 32 is turned off, the battery voltage VB rises.

When the starter switch 32 is OFF, and for a predetermined time after the starter switch 32 is switched to OFF, the rotation of the engine 1 does not fully stabilize, so this is not a suitable situation to perform fault diagnosis of the purge valve 8. Therefore, fault diagnosis is not performed until a time t5 (i.e., until engine 1 is fully stabilized). The engine 1 is already stable at a time t4 in the diagram, but some margin is provided before detecting the detection pressure P for fault diagnosis.

If the differential-pressure ΔP of the reference pressure Ps and the detection pressure P is more than predetermined differential-pressure ΔPth, as the purge valve 8 is open in spite of a close command from the controller 9, it is determined that the purge valve 8 has a fault. When the differential-pressure ΔPth is less than a predetermined differential-pressure ΔPth, and the inside of the pipes 7, 8 is maintained at substantially atmospheric pressure, it is determined that the purge valve 8 is operating normally.

Therefore, according to this invention, the pressure in the pipes 4, 7 immediately prior to engine starting when the starter switch 32 switches ON is detected, and this is set as the reference pressure Ps. The pressure P for fault diagnosis is detected by the absolute pressure sensor 9 when the rotation of the engine 1 is stabilized, and the fault of the purge valve 8 is diagnosed based on the differential pressure ΔP of the reference pressure Ps and the detection pressure P. Thus, a fault of the purge valve 8 can be diagnosed by providing only one absolute pressure sensor 9 in the pipes 4, 7, and there is no necessity to provide a sensor for detecting atmospheric pressure separately.

Further, after setting the reference value Ps, the pressure for determining the fault of the purge valve 8 is detected and the fault is determined within a predetermined time. This prevents a differential pressure occurring between the detection pressure P and reference pressure Ps due to the variation of atmospheric pressure, and prevents the purge valve 8 being diagnosed as faulty although it is normal. The predetermined time is a value determined according to the time until the rotation of the engine 1 is fully stabilized, and is set as 10 seconds in this embodiment.

Next, a leak determination of a space 40 (the fuel tank 2, pipes 4 and 7) from the fuel tank 2 to the purge valve 8, which is performed after the fault diagnosis of the purge valve 8, will be described.

Figure 5:
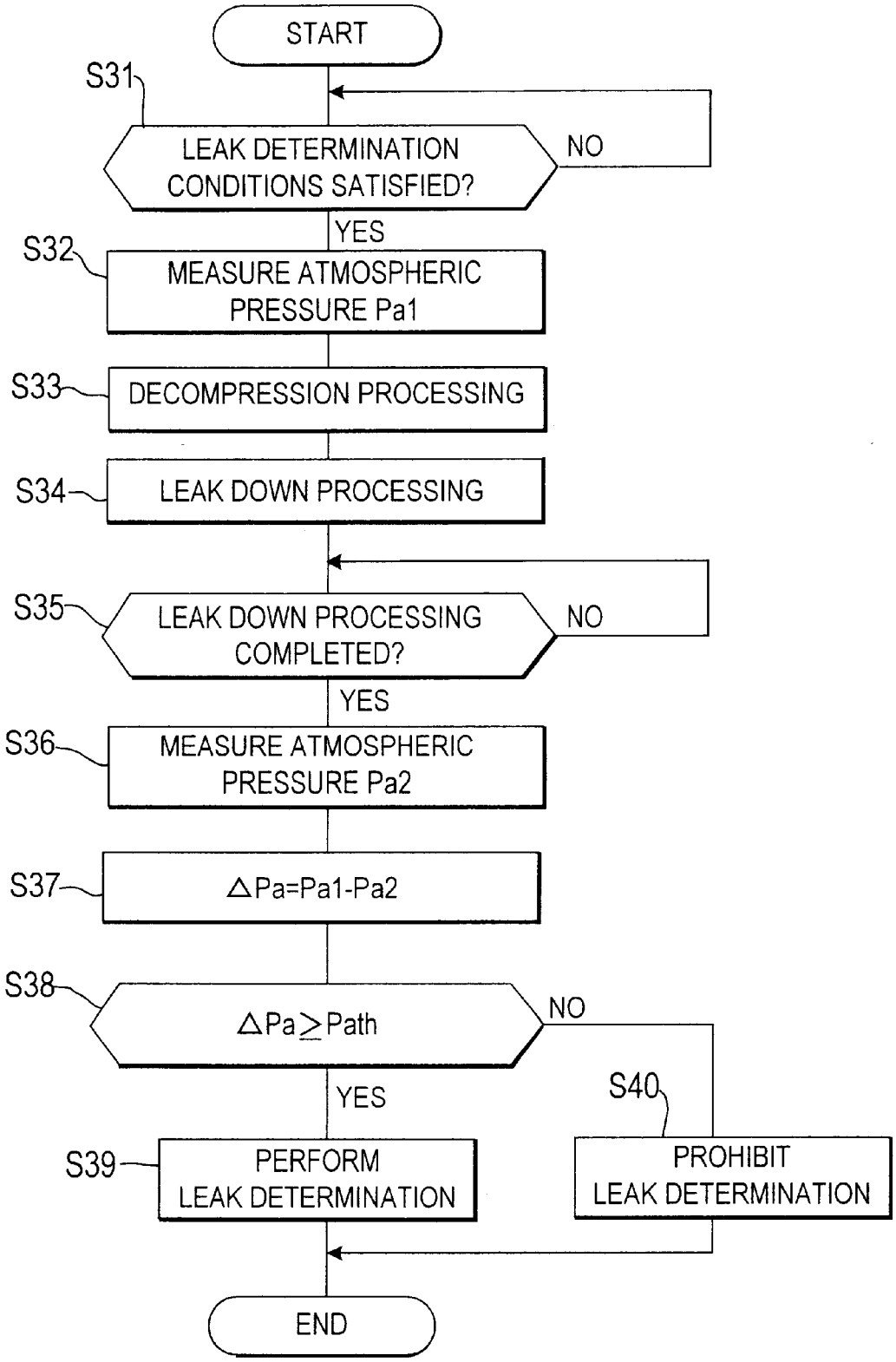
FIG. 5 is a flowchart showing a main routine of leak determining processing.

FIG. 5 shows the main routine of leak determining processing.

In a step S31, it is determined whether or not leak determination conditions are satisfied. In a predetermined running region wherein the purge valve 8 is closed, and when the cooling water temperature, intake air temperature, fuel temperature, atmospheric pressure, etc. are in the predetermined range and other diagnoses are normal, it is determined that leak determination conditions are satisfied.

When the leak determination conditions are satisfied, the routine proceeds to the step S32 and the atmospheric pressure Pa1 prior to leak determining is measured. The measurement of atmospheric pressure is performed by the subroutine of FIG. 6.

Figure 6:
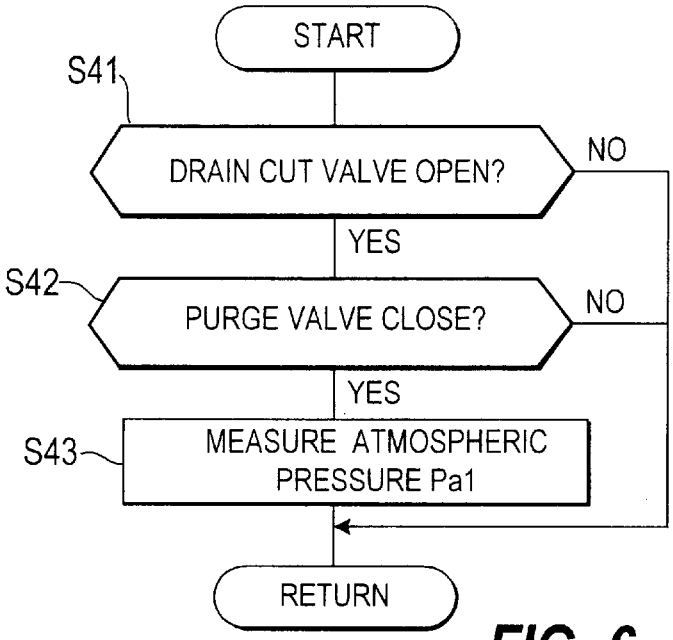
FIG. 6 is a flowchart showing a subroutine of leak determining processing.

In a step S41 of FIG. 6, it is determined whether the drain cut valve 11 is open, and in a step S42, it is determined whether the purge valve 8 is closed. If the drain cut valve 11 is open and the purge valve 8 is closed, the routine proceeds to a step S43 and the output value of the absolute pressure sensor 9 at that time is read as the atmospheric pressure Pa1. When a predetermined time has elapsed after the purge valve 8 is closed, the atmospheric pressure Pa1 before leak determination may be detected.

When performing purge processing, as the drain cut valve 11 is open and the opening of the purge valve 8 is adjusted according to running conditions etc., the pressure in the pipe 7 by which the absolute pressure sensor 9 is installed is a negative pressure due to the intake negative pressure of engine 1. If the purge valve 8 is closed in this state, the intake negative pressure of the engine 1 will be cut off, and the interior of the pipe 7 will become equal to atmospheric pressure. Therefore, according to the processing of FIG. 6, the atmospheric pressure Pa1 prior to leak determining is detected by the absolute pressure sensor 9.

Returning to FIG. 5, in a step S33, the drain cut valve 11 is closed, the purge valve 8 is opened, and the pressure of the space 40 is decompressed to predetermined negative pressure by the intake negative pressure of the engine 1 (decompression processing).

After decompression processing is complete, the routine proceeds to a step S34, the purge valve 8 is shut to close the space 40, and the absolute pressure sensor 9 detects the pressure change in the space 40 (leak down processing). In leak down processing, it measures how much the pressure in the space 40 increases in a predetermined time.

After finishing leak down processing, the routine proceeds from the step S35 to the step S36. In the step S36, the drain cut valve 11 is opened and the atmospheric pressure Pa2 after leak determining is measured. The atmospheric pressure Pa2 after leak determining is measured by the subroutine shown in FIG. 7.

Figure 7:
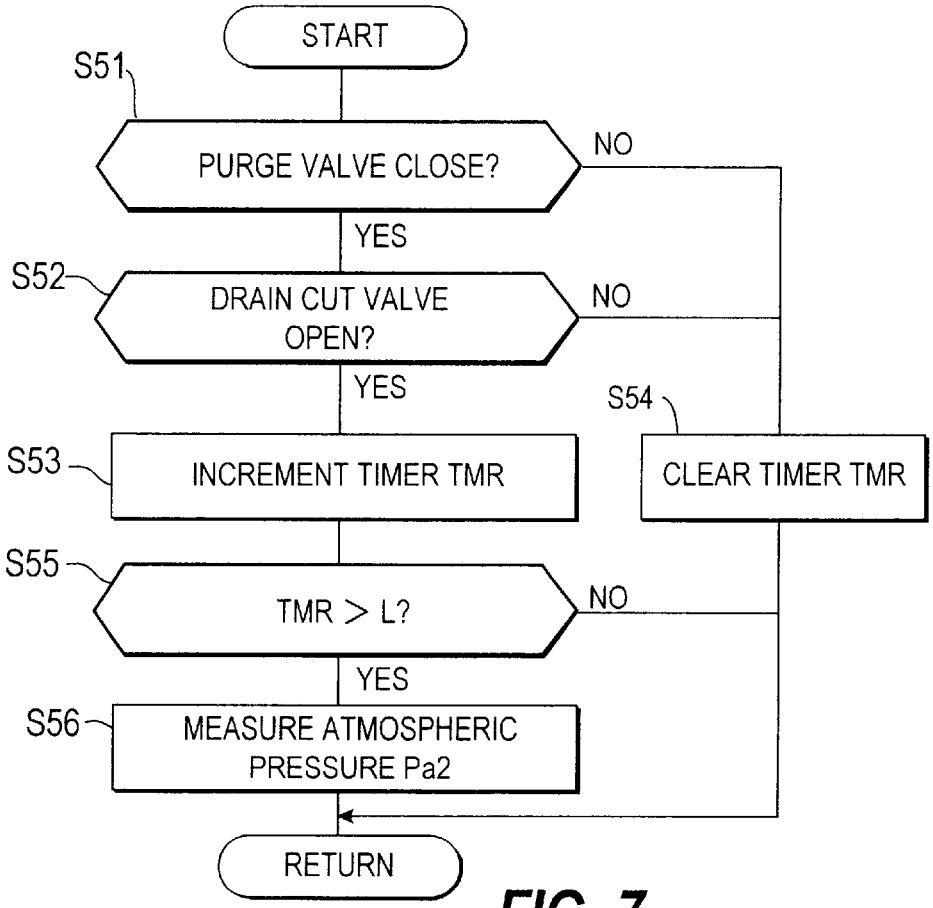
FIG. 7 is a flowchart showing a subroutine of leak determining processing.

In FIG. 7, in a step S51, it is determined whether the purge valve 8 has closed and in a step S52, it is determined whether the drain cut valve 11 is open. When the purge valve 8 has not closed or the drain cut valve 11 is not open, a timer TMR is cleared in a step S54.

If the purge valve 8 has closed and the drain cut valve 11 is open, in a step S53, the timer TMR is incremented, the time for which this state continues is counted, and the routine proceeds to a step S55.

In the step S55, if the predetermined time L is counted by the timer TMR, i.e., if the predetermined time L elapses when the purge valve 8 is closed and the drain cut valve 11 is open, the output value of the absolute pressure sensor 9 at that time is read as atmospheric pressure in a step S56.

After the leak determining, by opening the drain cut valve 11, air flows into the pipe 7 in which the absolute pressure sensor 9 is installed. If the state where the purge valve 8 has closed and the drain cut valve 11 is open continues for the predetermined time L, the interior of the pipe 7 will be atmospheric pressure, so the atmospheric pressure Pa2 after the leak determining is detected by the absolute pressure sensor 9.

Returning to FIG. 5, in the step S37, the difference ΔPa (atmospheric pressure change) of the atmospheric pressure Pa1 before leak determining and the atmospheric pressure Pa2 after the leak determining is computed.

In a step S38, the atmospheric pressure change ΔPa is compared with a predetermined threshold-value ΔPath. If the atmospheric pressure change ΔPa is smaller than the threshold-value ΔPath, the routine proceeds to a step S39 and leak determining will be performed.

In leak determining, the data measured in the step S34 (increase amount in the predetermined time of the pressure in the space 40) is compared with a predetermined value. When it is below the predetermined value, it is determined to be normal (no leak). When it exceeds the predetermined value, it is determined to be abnormal (leak).

On the other hand, when the atmospheric pressure change ΔPa exceeds the threshold-value ΔPath, leak determining is prohibited in the step S40, and the data measured in the step S34 is reset.

Figure 8:
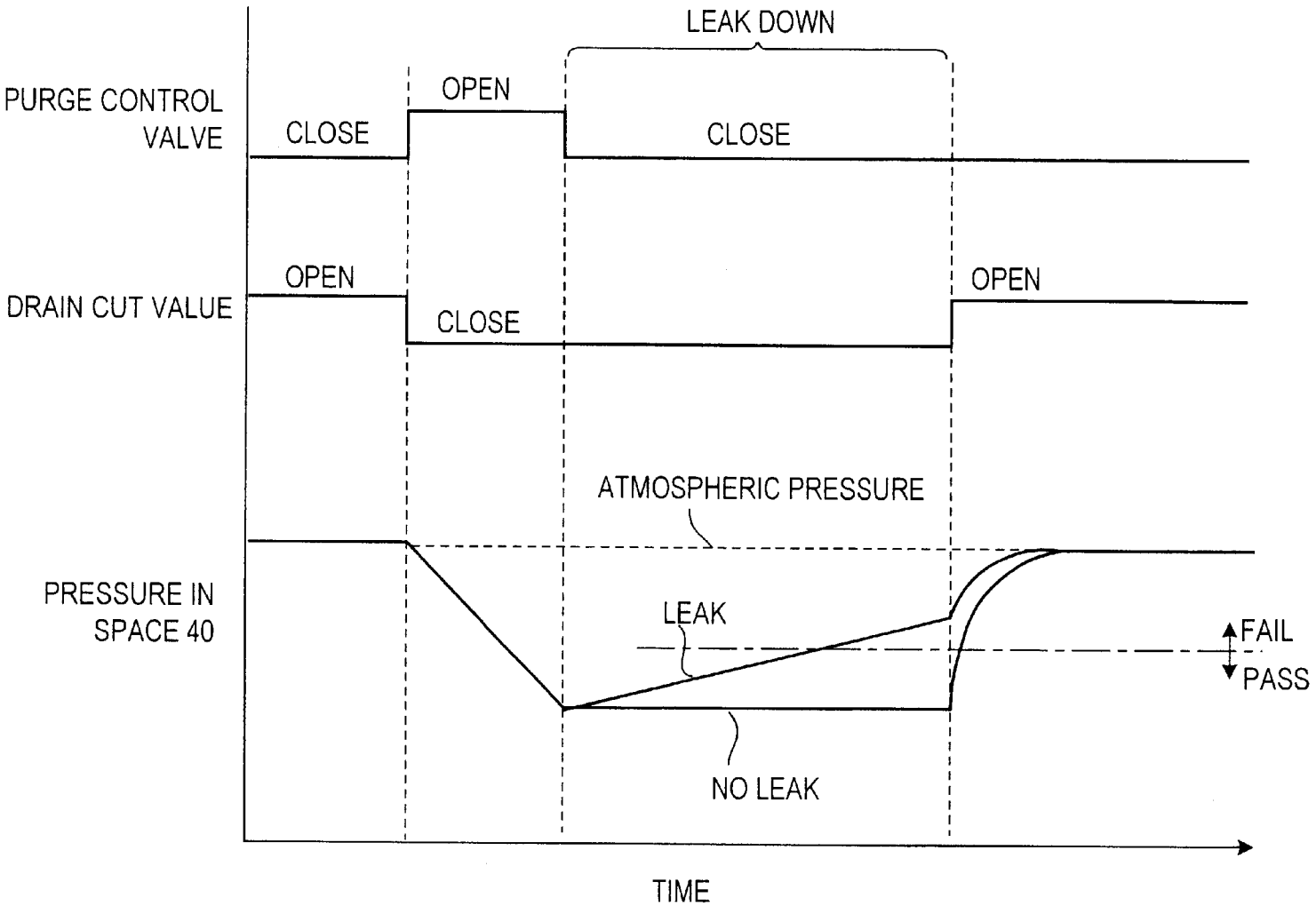
FIG. 8 is a timing chart showing the operation of the system when performing leak determining processing.
Figure 9:
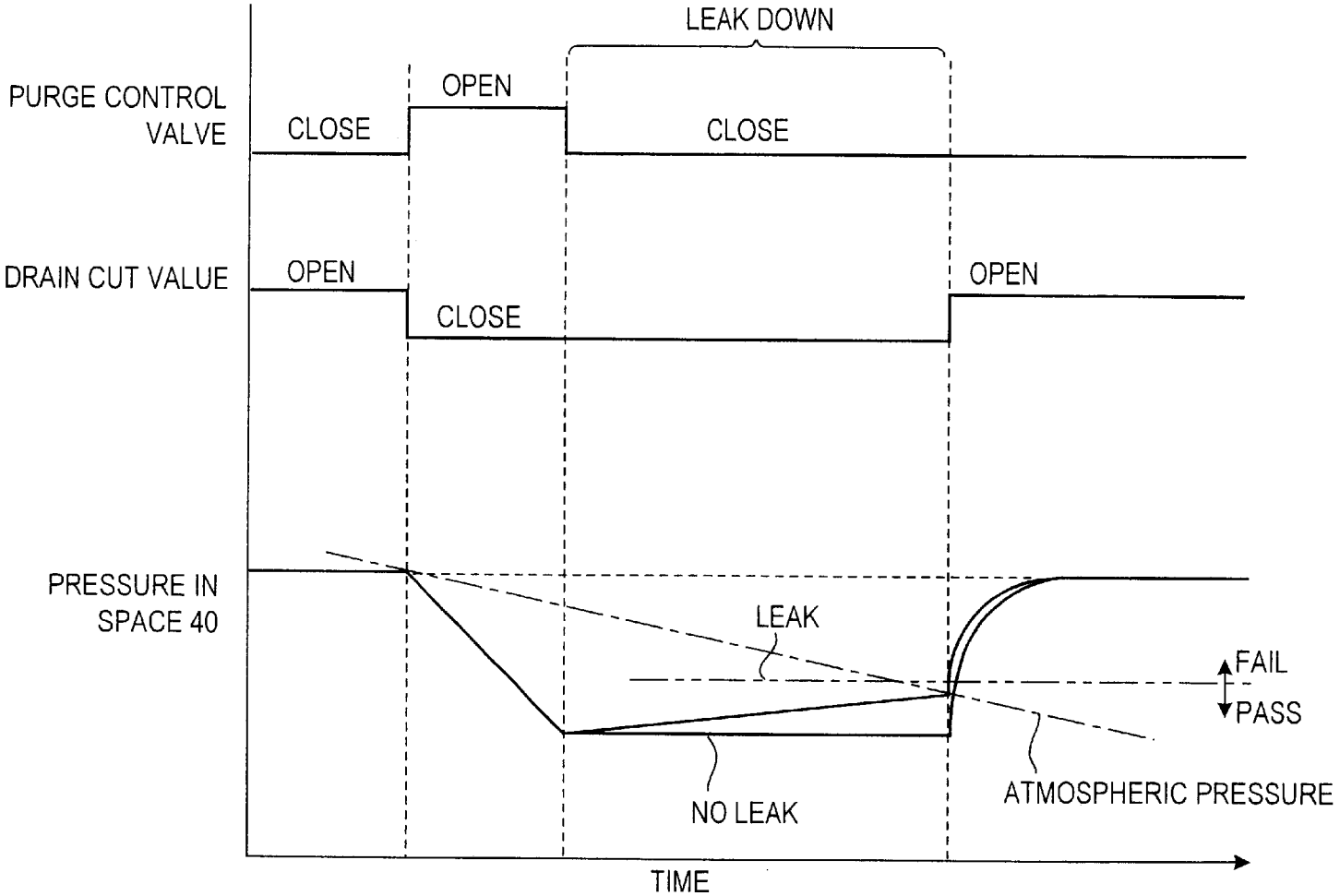
FIG. 9 is a timing chart showing the operation of the system when performing leak determining processing.

FIG. 8 and FIG. 9 are timing charts showing operation of the system when performing leak determining control.

FIG. 8 shows the case where there is no change of atmospheric pressure. In the leak determining, when there is no leak, the pressure in the space 40 does not change, but when the increase amount of the pressure in the space 40 exceeds a predetermined value, it determined that there is a fault (leak).

FIG. 9 shows the case where the atmospheric pressure changed between before and after leak determination. As it is impossible to make a leak determination correctly when the atmospheric pressure varies, leak determining is prohibited when the change of atmospheric pressure exceeds a predetermined value.

Thus, by installing the one absolute pressure sensor 9 to detect the pressure in the space 40, the pressure in the space 40 and atmospheric pressure can be detected, and it is unnecessary to provide plural pressure sensors.

The atmospheric pressure is detected when the drain cut valve 11 is open and the purge valve 8 is closed, so the atmospheric pressure can be detected with sufficient accuracy. As the pressure in the space 40 and atmospheric pressure are detected by one absolute pressure sensor, the diagnostic equipment is simplified.

In the leak determining, the absolute pressure sensor 9 detects atmospheric pressure before and after diagnosis, and when the change of atmospheric pressure exceeds a predetermined value, leak determining is prohibited. Thereby, incorrect diagnosis of leak determining due to a variation of atmospheric pressure can be prevented.

After starting the leak determining, if the atmospheric pressure falls due for example to the vehicle driving up a hill, as the relative pressure between the pressure in the space 40 and atmospheric pressure becomes small as shown in FIG. 9, the pressure increase amount in the space 40 may be small even if there is leak, and it may be diagnosed by the leak determining that there is no leak. However, when the atmospheric pressure variation amount exceeds a predetermined value, leak determination is prohibited as mentioned above, so incorrect diagnosis of the leak determination due to atmospheric pressure variation can be prevented.

When the leak determining is finished, immediately after opening the drain cut valve 11 with the purge valve 8 closed, negative pressure remains in the space 40. However, since the atmospheric pressure after leak determining is detected when a predetermined time has elapsed after opening the drain cut valve 11, the atmospheric pressure can be detected correctly.

Figure 10:
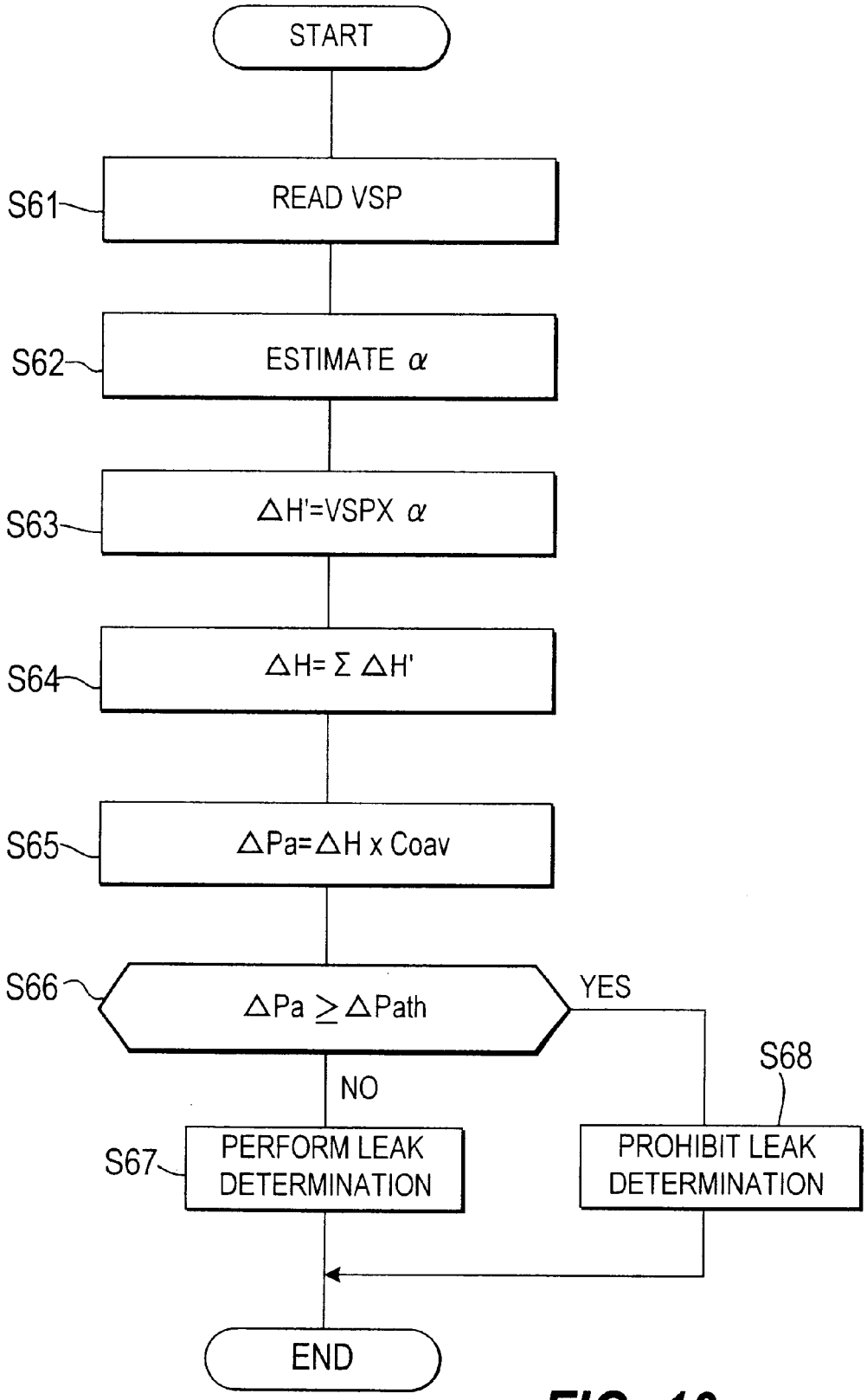
FIG. 10 is a flowchart showing another example of leak determining processing.

FIG. 10 shows another example of the leak determination. This estimates the change of atmospheric pressure by the vehicle speed VSP and the slope angle α of the road instead of by detecting the atmospheric pressure with the absolute pressure sensor 9.

This routine will be started if the leak determination conditions (same as the step S31 of FIG. 5) are satisfied.

In a step S61, the vehicle speed VSP is read.

In a step S62, the slope angle α of the road is estimated. The present engine rotation speed Ne and the engine load (throttle opening TVO, etc.), are compared with the engine rotation speed Ne and the engine load (throttle opening TVO, etc.) when running on flat ground running which are prestored, and the slope angle α is estimated from their magnitudes and their difference. For example, if the engine load is the same and the present engine rotation speed Ne is low, it can be determined that the vehicle is running uphill.

In the step S63, the vehicle speed VSP is multiplied by the estimated slope angle α to calculate a height variation rate ΔH per unit time. When driving uphill, the estimated slope angle α and height variation rate ΔH are positive, and when driving downhill, the estimated slope angle α and height variation rate ΔH are negative.

In a step S64, the height variation rate ΔH is integrated over each computation timing to obtain a height variation ΔH.

In a step S65, an atmospheric pressure variation ΔPa is calculated by multiplying the height variation ΔH by an atmospheric pressure variation coefficient Coav. The atmospheric pressure variation coefficient Coav may be set to, for example, 9 mmHg per 100 m of height variation In a step S66, it determines whether the leak determination is performed based on the atmospheric pressure change ΔPa. When it is determined that the atmospheric pressure change ΔPa is less than the threshold-value ΔPath, the routine proceeds to a step S67 and the leak determination is performed. When it is determined that the atmospheric pressure variation ΔPa exceeds the threshold-value ΔPath, the routine proceeds to a step S68 and the leak determination is prohibited.

In this way, it is not necessary to wait for the result of monitoring the atmospheric pressure variation before and after leak determination, and the leak determination can be cancelled in real time.

Figure 11:
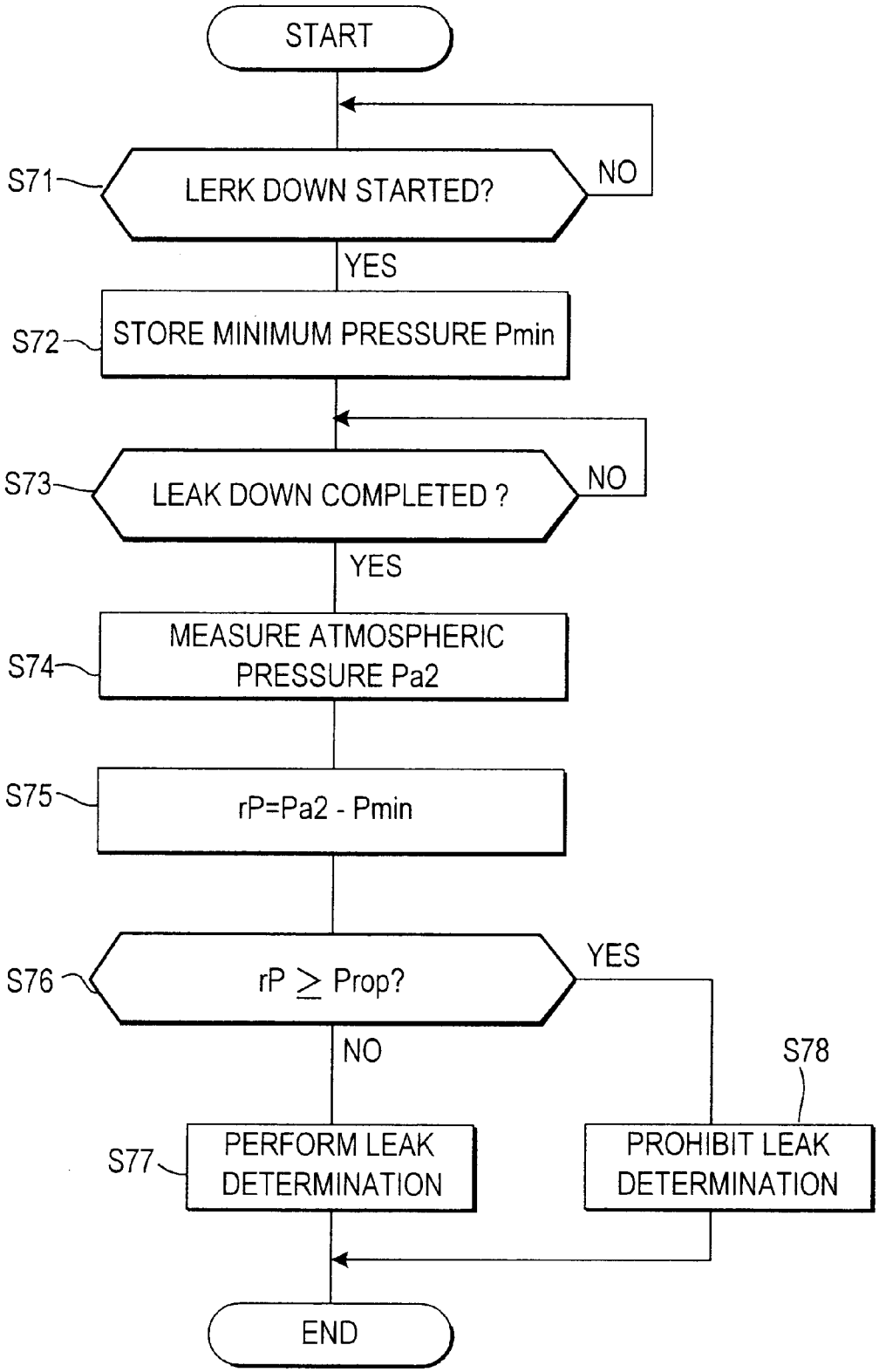
FIG. 11 is a timing chart showing the operation of the system when performing another example of leak determining processing.

FIG. 11 shows still another example of the leak determination. Here, leak determination is prohibited when the difference of the pressure P in the space 40 and the atmospheric pressure Pa is higher than a valve opening pressure Prop of a relief valve (not shown) provided in a filler cap 12 of the fuel tank 2.

In a step S71, it is determined whether leak down processing is started.

When leak down processing is started, in the step S72, the minimum value of the pressure P in the space 40 detected by the absolute pressure sensor 9 during leak down processing is stored in a memory as a pressure Pmin during leak down.

After leak down processing is completed, the routine proceeds from the step S73 to the step S74, the drain cut valve 11 is opened, and the detection value of the absolute pressure sensor 9 is stored in the memory as an atmospheric pressure Pa2 after the leak determining.

In a step S75, the difference rP (leak down relative pressure) between the atmospheric pressure Pa2 after leak determining and the pressure Pmin during leak down, is calculated.

In a step S76, the leak down relative pressure rP is compared with the valve opening pressure Prop of the relief valve installed in the filler cap 12 of the fuel tank 2, and if the leak down relative pressure rP is less than the valve opening pressure Prop, the routine proceeds to a step S77 and leak determination is performed.

On the other hand, if the leak down relative pressure rP is more than the valve opening pressure Prop, the routine proceeds to a step S78 and the leak determination is prohibited.

Figure 12:
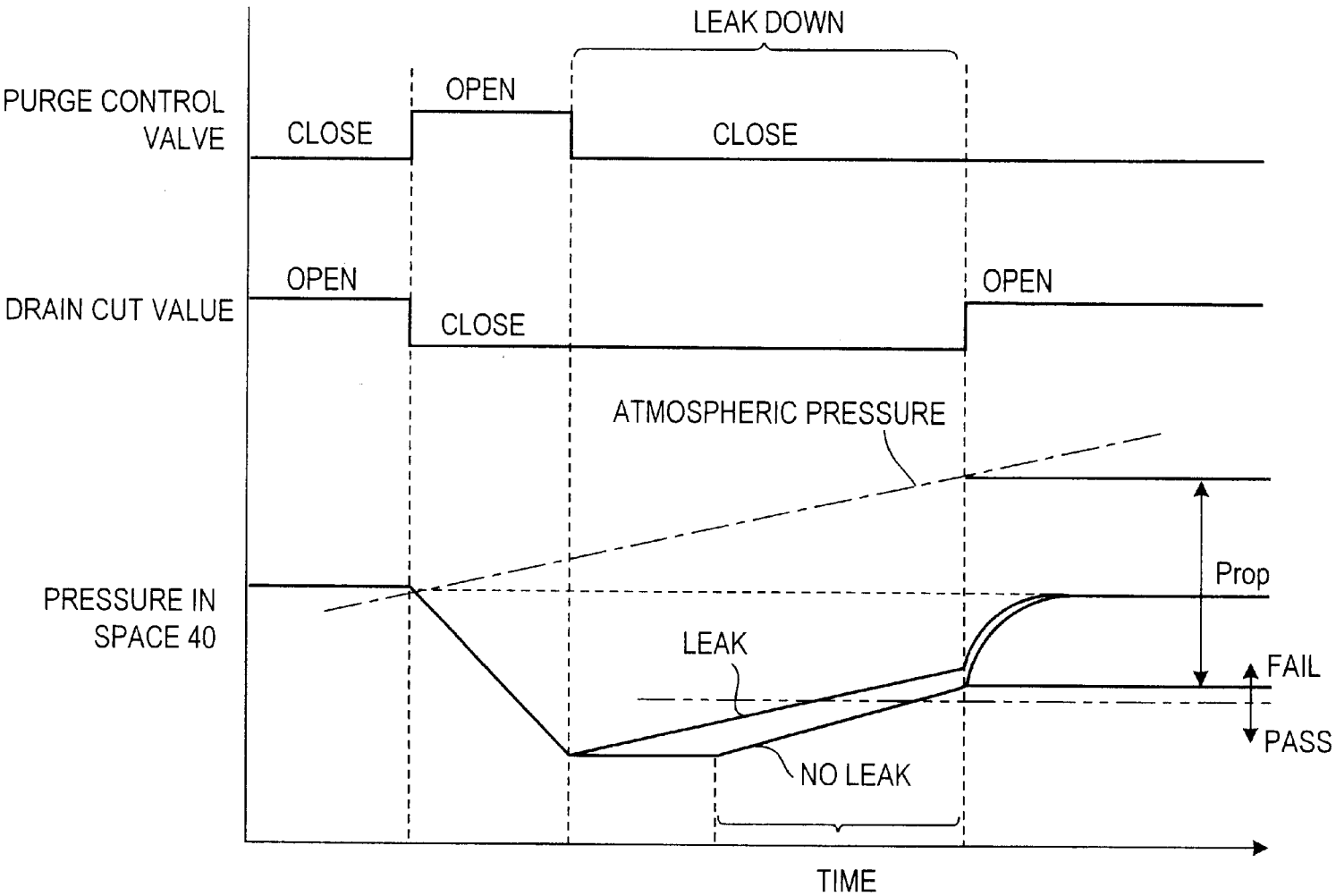
FIG. 12 is a flowchart showing another example of leak determining processing.

FIG. 12 shows a timing chart of this leak determination control.

After starting leak determination, when the atmospheric pressure rises due for example to the vehicle running on a downward slope and the relative pressure rP of the pressure P in the space 40 and the atmospheric pressure Pa becomes large, the relief valve of the filler cap 12 will open, atmospheric air will flow into the space 40 and the pressure P in the space 40 will increase even if there is no leak.

However, when the difference of the pressure P in the space 40 and atmospheric pressure Pa is larger than the valve opening pressure Prop of the relief valve of the filler cap 12, leak determination is prohibited, so incorrect diagnosis resulting from the operation of the relief valve of the filler cap 12 can be prevented.

Figure 13:
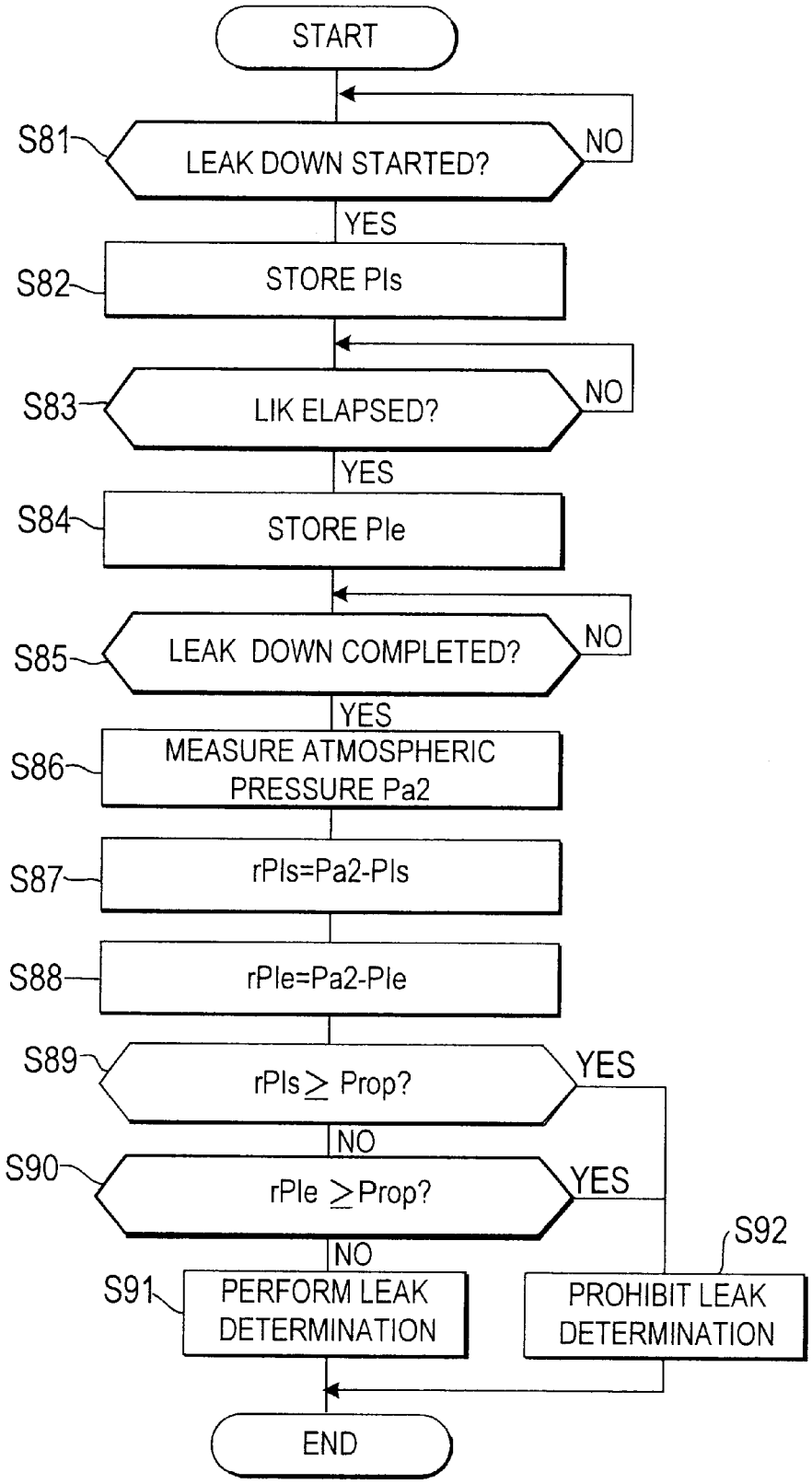
FIG. 13 is a flowchart showing another example of leak determining processing.

FIG. 13 shows yet another example of the leak determination. In this example, a pressure Pls in the space 40 at the start of leak determination and the pressure Ple in the space 40 at the end of leak determination are measured, and when the difference of the pressures Pls, Ple and atmospheric pressure Pa is larger than the pressure Prop of the relief valve of the filler cap 12 of the fuel tank 2, leak determination is prohibited.

In a step S81, the leak down processing start is determined. If leak down processing is started, in the step S82, the pressure P in the space 40 detected by the absolute pressure sensor 9 is stored in a memory as the leak down start pressure Pls.

In a step S83, a leak down time Llk is measured. When the leak down time Llk has elapsed, in the step S84, the pressure P in the space 40 detected by the absolute pressure sensor 9 is stored in the memory as the leak down end pressure Ple.

After terminating leak down processing, the routine proceeds from the step S85 to S86, the drain cut valve 11 is opened, and the pressure P detected by the absolute pressure sensor 9 is stored in the memory as the atmospheric pressure Pa2 after leak determining.

In a step S87, a difference rPls (leak down start time relative pressure) of the atmospheric pressure Pa2 after leak determining and the leak down start pressure Pls is calculated. In a step S88, a difference rPle (leak down end time relative pressure) of the atmospheric pressure Pa2 after leak determining and the leak down end pressure Ple is calculated.

In steps S89 and S90, the leak down start relative pressure rPls and the leak down end relative pressure rPle are compared with the valve opening pressure Prop of the relief valve of the filler cap 12 of the fuel tank 2, and if they are both less than the valve opening pressure Prop, leak determining will be performed in the step S91.

If one of the leak down start relative pressure rPs or the leak down end relative pressure rPle is larger than the valve opening pressure Prop, the routine will proceed to a step S92 and leak determining will be prohibited.

In this way, the pressure used to determine whether or not to perform leak determining can be measured easily compared with detecting the minimum value Pmin of the pressure in the space 40. Only one of the leak down start pressure Pls or the leak down end pressure Ple may be detected, and only one of the values used to determine whether or not to perform the leak determination.

Next, a second embodiment of this invention will be described.

In the first embodiment, ON/OFF of the starter switch 32, i.e., starting of engine 1, at the time of fault diagnosis of the purge valve 8, was detected by the mechanical switch 19. In the second embodiment, starting of the engine 1 is electrically detected based on the crank position signal from the crank angle sensor 20.

However, a time delay will occur from when the starter switch 32 actually switches ON to when starting of the engine 1 is detected electrically. This is because, even if the starter switch 32 is ON, there is a delay until the starter motor 31 rotates, the rotation of the starter motor 31 is transmitted to the engine 1 via a ring gear, and a crank position signal from the crank angle sensor 20 is output to the controller 15.

When the rotation of the engine 1 increases, negative pressure will occur in the intake passage 6, and this causes negative pressure in the space 40. Therefore, the negative pressure in space 40 increases and the reference pressure Ps shifts to the negative pressure side, the longer it takes to detect the starting of the engine 1. When the reference pressure Ps shifts to the negative pressure side, and when the purge valve 8 has a fault, the differential pressure between the reference pressure Ps and the pressure P used for fault diagnosis decreases, so it may occur that it is determined that the purge valve 8 does not have a fault although it is faulty, and the precision of fault diagnosis decreases.

In the second embodiment, even in the case where starting of the engine 1 is detected electrically, high fault diagnostic accuracy is maintained.

Figure 14:
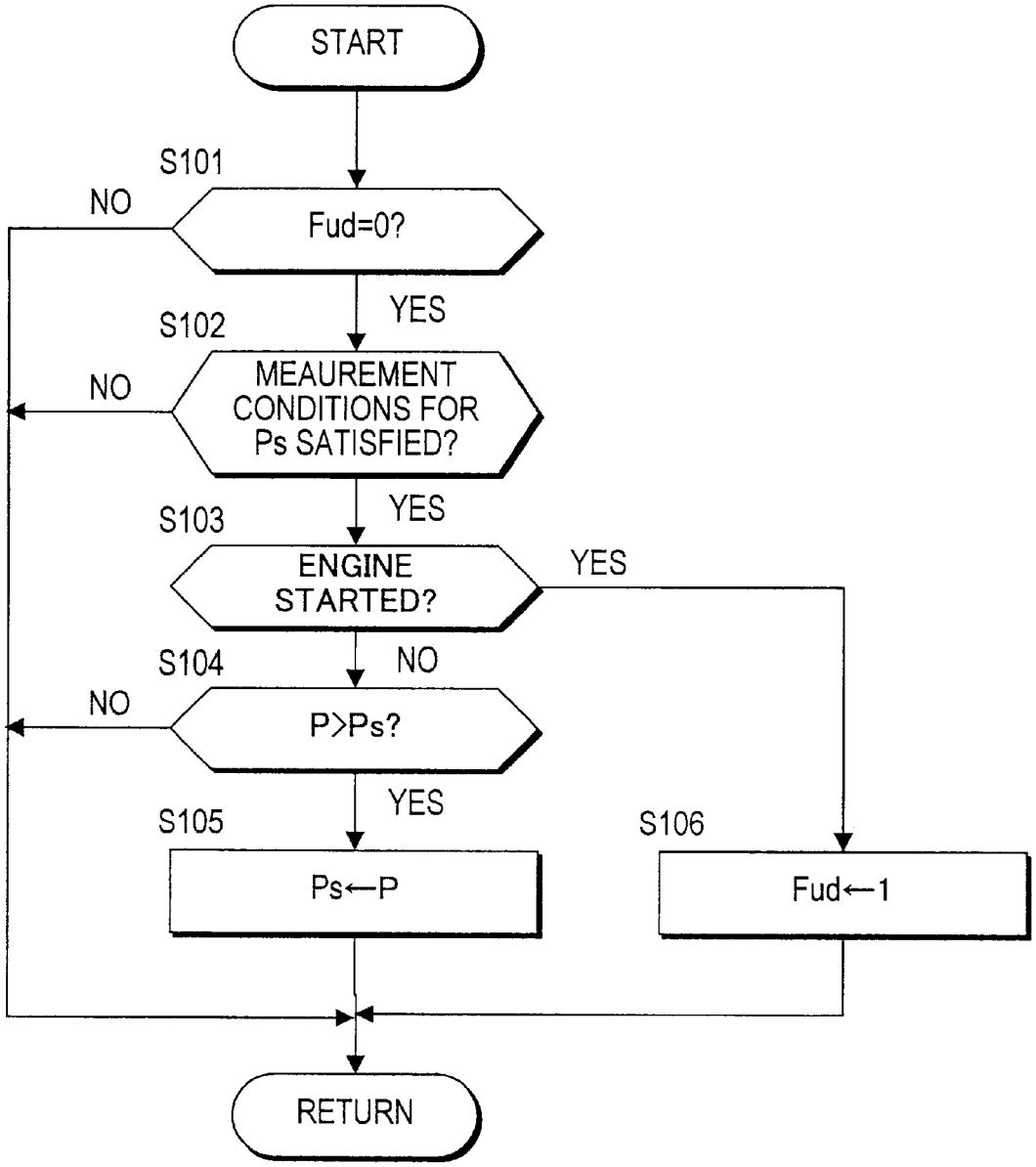
FIG. 14 is similar to FIG. 2, but showing a second embodiment of this invention.

The flowchart of FIG. 14 is a flowchart showing the processing which sets the reference pressure Ps, and it is performed at a predetermined interval, for example, 10 milliseconds. The initial value of the reference pressure Ps is stored beforehand.

In a step S101, the updating flag Fud ("0" or "1") of the reference pressure Ps is examined. When the updating flag Fud is "0", the routine proceeds to a step S102, and it is determined whether or not the measurement conditions for fault diagnosis are satisfied. On the other hand, when the updating flag Fud is "1", processing is terminated. The initial value of the updating flag Fud is "0."

In order to satisfy the measurement conditions for the reference pressure Ps, it is necessary to satisfy all the following conditions:

(1) A Fail determination, such as when for example the boost pressure sensor 19 is faulty, has not been issued.

(2) The drain cut valve 11 is open.

(3) The purge valve 8 is closed.

(4) The ignition switch 22 is ON.

(5) The engine rotation speed is lower than a first predetermined rotation speed (for example, 500 rpm).

(6) The battery voltage is more than 8V.

When all of these conditions are satisfied, the routine proceeds to a step S103, otherwise processing is terminated.

In the step S103, starting of the engine 1 is determined electrically. Specifically, when the crank position signal from the crank angle sensor 20 is detected, it is determined that the engine 1 has started.

When starting of the engine 1 is not detected, the routine proceeds to a step S104, and when starting of the engine 1 is determined, the routine proceeds to a step S106 and the updating flag Fud is set to "1."

In the step S104, it is determined whether the detection pressure P measured by the absolute pressure sensor 9 is higher than the reference pressure Ps. If it is higher, the routine proceeds to the step S105, and when it is low, processing is terminated.

In the step S105, the detection pressure P is newly stored as the reference pressure Ps. Due to this updating process, the maximum value of the pressure in the pipe 7 until starting of the engine 1 was detected is set as the reference pressure Ps.

After the reference pressure Ps is set by the flowchart of FIG. 14, the control which performs pressure determining for determining a fault of the purge valve 8 is the same as that of the flowchart shown in FIG. 3.

Figure 15:
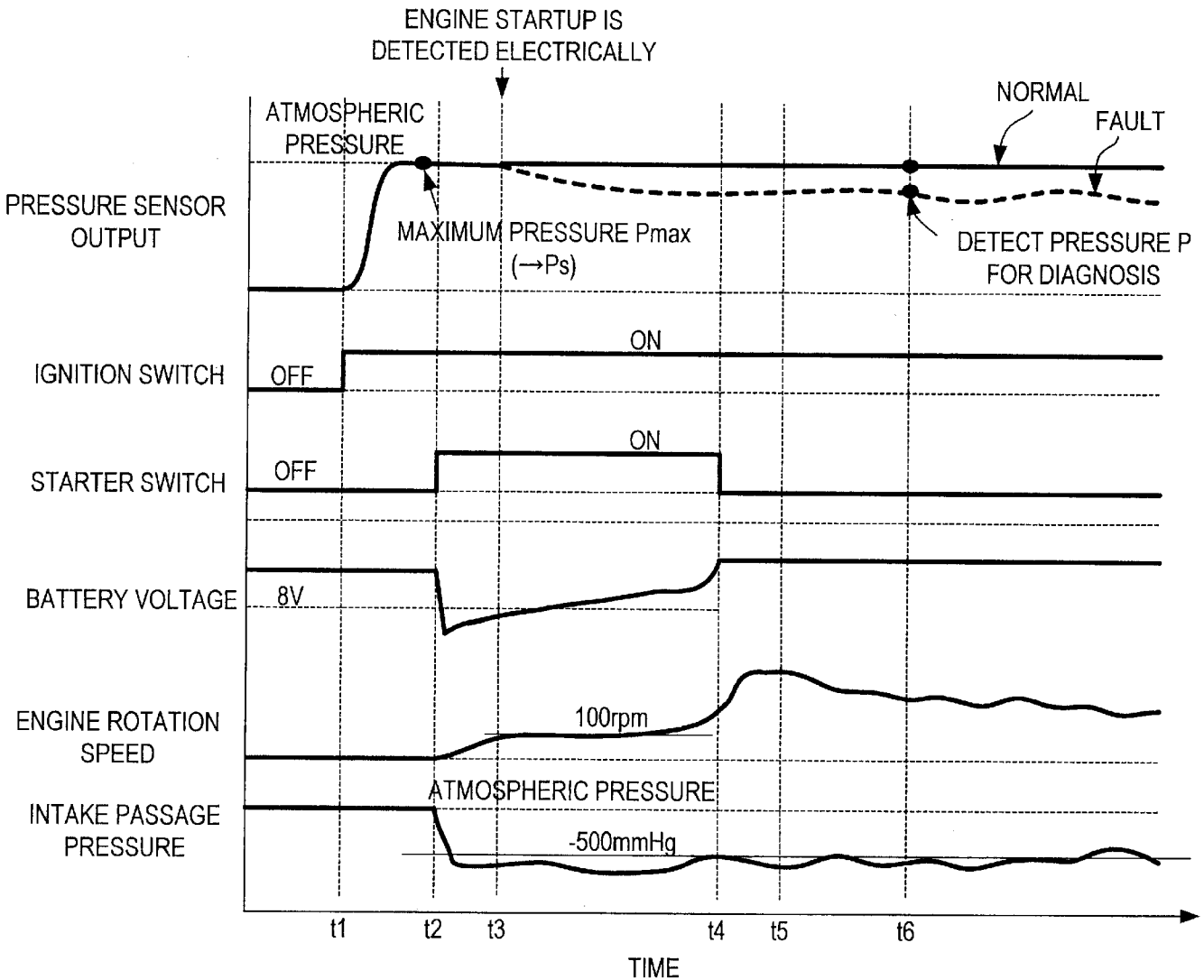
FIG. 15 is a timing chart showing the operation of the system when performing reference pressure setting processing in the second embodiment.

The timing chart shown in FIG. 15 shows the operating state of each component when performing fault diagnosis of the purge valve 8 according to the second embodiment.

At a time t1, the ignition switch 22 is switched ON and the measurement conditions for the reference pressure Ps are determined. If the reference pressure measurement conditions are satisfied and the starter switch 32 is OFF, the detection value of the absolute pressure sensor 9 is stored.

At a time t2, the starter switch 32 is switched ON and the engine 1 starts. Accordingly, the battery voltage VB falls and the pressure in the intake passage 6 also declines. However, at this time, starting of engine 1 is not yet detected. Pressure detection by the absolute pressure sensor 9 is carried out until starting of engine 1 is electrically detected based on the signal from the crank angle sensor 20.

At a time t3, starting of engine 1 is detected electrically and the pressure detection by the absolute pressure sensor 9 is terminated. The maximum value Pmax of the pressure value detected after the pressure detection by the absolute pressure sensor 9 is started until a time t3, is set as the reference pressure Ps.

At a time t4, the starter switch 32 is OFF, but the engine 1 continues rotating. As the starter motor 31 stops consuming electricity when the starter switch 32 is OFF, the battery voltage VB rises.

When the starter switch is ON and for a predetermined time after the starter switch 32 has changed over to OFF, the rotation of the engine 1 is not fully stable so it is not a suitable time for fault diagnosis of the purge valve 8. Thus, fault diagnosis is not performed until a time t6 (i.e., until rotation of engine 1 has stabilized). In FIG. 15, the engine 1 is already stable at a time t5 in the diagram, but some margin is provided before detecting the detection pressure P for fault diagnosis.

If the differential pressure between the reference pressure Ps and the detection value P is larger than a predetermined value, it is determined that the purge valve 8 is open despite a close command from the controller 9, and it will be diagnosed that the purge valve 8 is faulty. When the differential pressure is less than a predetermined value, and the pressure in the pipe 7 is maintained at substantially atmospheric pressure, it is determined that the purge valve 8 is normal.

By setting the reference pressure Ps in this way, even if the starting of the engine 1 is detected electrically, and there is a delay from when the starter switch 32 actually switches ON to when starting of the engine 1 is detected, the effect of introduction of negative pressure into the pipe 7 from the intake passage 6 after cranking can be eliminated, and an almost precise atmospheric pressure can be set as the reference pressure Ps.

The entire contents of Japanese Patent Applications P2001-228953 (filed Jul. 30, 2001) and P2002-68534 (filed Mar. 13, 2002) are incorporated herein by reference.

Although the invention has been described above by reference to a certain embodiment of the invention, the invention is not limited to the embodiment described above. Modifications and variations of the embodiments described above will occur to those skilled in the art, in the light of the above teachings. The scope of the invention is defined with reference to the following claims.

What is claimed is:

1. A fuel evaporative emission control system of an engine comprising:

a fuel tank, a passage connecting the fuel tank and an intake passage of the engine, a canister provided in the passage, which adsorbs fuel evaporating gas vaporized in the fuel tank, a purge valve installed between the intake passage and the canister, a sensor which is provided between the purge valve and the fuel tank and detects the pressure in the passage, and a controller functioning to detect the pressure in the passage before engine startup as an atmospheric pressure.

2. The emission control system as defined in claim 1, wherein:

the pressure in the passage before engine startup is the pressure in the passage immediately prior to engine startup.

3. The emission control system as defined in claim 1, further comprising:

a sensor which electrically detects engine startup, wherein the pressure in the passage before engine startup is the maximum value of the pressures detected until the engine startup is electrically detected.

4. A fuel evaporative emission control system of an engine, comprising:

a fuel tank, a passage connecting the fuel tank and an intake passage of the engine, a canister provided in the passage, which adsorbs fuel evaporating gas vaporized in the fuel tank, a purge valve installed between the intake passage and the canister, a sensor which is provided between the purge valve and the fuel tank and detects the pressure in the passage, and a controller functioning to:

detect the pressure in the passage before engine startup as a first pressure, detect the pressure in the passage after engine startup as a second pressure, compute the pressure difference between the first pressure and the second pressure, and determine a fault of the purge valve based on the pressure difference.

5. The emission control system as defined in claim 4, wherein the controller further functions to detect the second pressure a predetermined time after detecting the first pressure.

6. The emission control system of as defined in claim 4, wherein the pressure in the passage before engine startup is the pressure in the passage immediately prior to engine startup.

7. The emission control system as defined in claim 4, further comprising:

a sensor which electrically detects a rotation of the engine, wherein the pressure in the passage before engine startup is the maximum value of the pressures detected until the engine startup is electrically detected.

8. An atmospheric pressure detection method for a fuel evaporative emission control system of an engine, the system including a fuel tank, a passage connecting the fuel tank and an intake passage of the engine, a canister provided in the passage, which adsorbs fuel evaporating gas vaporized in the fuel tank, and a purge valve installed between the intake passage and the canister, the method comprising:

detecting the pressure in the passage, and setting the detected pressure before engine startup as an atmospheric pressure.

9. An atmospheric pressure detection method for a fuel evaporative emission control system of an engine, the system including a fuel tank, a passage connecting the fuel tank and the intake passage of the engine, a canister provided in the passage, which adsorbs fuel evaporating gas vaporized in the fuel tank, and a purge valve installed between the intake passage and the canister, the method comprising:

detecting the pressure in a passage before engine startup as a first pressure, detecting the pressure in the passage after engine startup as a second pressure, computing the pressure difference between the first pressure and second pressure and determining a fault of the purge valve based on the pressure difference.

10. A fuel evaporative emission control system of an engine comprising:

a fuel tank, a passage connecting the fuel tank and an intake passage of the engine, a canister provided in the passage, which adsorbs fuel evaporating gas vaporized in the fuel tank, a purge valve installed between the intake passage and the canister, and means for detecting the pressure in the passage before engine startup as an atmospheric pressure.

11. A fuel evaporative emission control system of an engine, comprising:

a fuel tank, a passage connecting the fuel tank and an intake passage of the engine, a canister provided in the passage, which adsorbs fuel evaporating gas vaporized in the fuel tank, a purge valve installed between the intake passage and the canister, means for detecting the pressure in the passage before engine startup as a first pressure, means for detecting the pressure in the passage after engine startup as a second pressure, means for computing the pressure difference between the first pressure and the second pressure, and means for determining a fault of the purge valve based on the pressure difference.

* * * * *